US005402624A

United States Patent [19]

Suga

[11] Patent Number: 5,402,624

[45] Date of Patent: Apr. 4, 1995

[54] APPARATUS FOR FOLDING FILM AVAILABLE FOR COVERING TRAYS

[75] Inventor: Tadoru Suga, Ibaraki, Japan

[73] Assignee: Ibaraki Seiki Machinery Company, Ltd., Osaka, Japan

[21] Appl. No.: 72,760

[22] Filed: Jun. 7, 1993

[51] Int. Cl.[6] ..... B65B 9/06

[52] U.S. Cl. ..... 53/550; 53/547; 53/374.7; 53/375.5

[58] Field of Search ..... 53/206, 374.5, 374.7, 53/375.5, 387.2, 387.3, 547, 550

[56] References Cited

U.S. PATENT DOCUMENTS

| | | | |
|---|---|---|---|
| 3,099,118 | 7/1963 | Stelling | 53/387.3 X |
| 3,973,372 | 8/1976 | Omori | 53/547 X |
| 4,144,697 | 3/1979 | Suga | 53/547 X |
| 4,483,125 | 11/1984 | Suga . | |
| 4,571,927 | 2/1986 | Suga | 53/547 |
| 4,601,159 | 7/1986 | Mughai | 53/550 X |
| 4,841,715 | 7/1989 | Suga | 53/547 |
| 4,924,658 | 5/1990 | Takehama | 53/547 |

*Primary Examiner*—John Sipos
*Assistant Examiner*—Daniel Moon
*Attorney, Agent, or Firm*—Barnes, Kisselle, Raisch, Choate, Whittemore & Hulbert

[57] ABSTRACT

An apparatus for tubularly covering each of a plurality of trays containing a packaged object with film while elongating the film itself. In the course of conveying each tray in the longitudinal direction of the tubular film, the film itself is cut off between a pair of adjoining trays aligned in the front and on the back. Simultaneous with execution of a cutting operation, a pair of edges of the tubular film are respectively subject to vacuum by vacuum absorptive force in a pair of suction tubes each being disposed on the up-and-downstream sides of the cutting unit. The suction tube on the downstream side is transferable in the direction identical to the direction of conveying these trays. The suction tube on the downstream side returns to the original position by the time at which the following tray arrives at this position.

2 Claims, 9 Drawing Sheets

APPARATUS FOR FOLDING FILM AVAILABLE FOR COVERING TRAYS

FIELD OF THE INVENTION

The present invention relates to an apparatus for folding a film available for covering a tray, where the apparatus tubularly covers periphery of a tray containing a packaged object with a plastic film having substantial elongating and elastic property by way of elongating the film itself, and simultaneously, the apparatus seals the packaged object by folding both edges of the tubular film alongside of the bottom surface of the corresponding tray.

BACKGROUND OF THE INVENTION

The U.S. Pat. No. 4,483,125 discloses such an apparatus which conveys a number of trays each containing food on a belt-driven conveyer aligned in file at equal intervals. Concurrently, the apparatus sequentially converts a belt-like film into tubular form in the periphery of each tray while continuously drawing out the film in the longitudinal direction. Next, the apparatus causes a cutting unit to cut off the tubular film between a pair of trays passing over the cutting unit. At the same time, the apparatus causes a pair of suction tubes aligned in the front and on the back apart from the cutting unit to pull both edges of the cut-off film in the direction of the ground surface. Next, the apparatus folds both edges of the film in the front of the forward-moving tray while causing those suction tubes to respectively hold both edges of the film and then fold both edges alongside of the bottom surface of the tray by applying the forward movement of the tray, whereas both edges of the film behind the forwarding tray are also folded along-side of the bottom surface of the tray in the manner of being caught by a pair of rods which shift themselves at a speed faster than that of the moving tray while holding both edges by means of the suction tubes.

On the other hand, the apparatus disclosed in the above U.S. Pat. No. 4,483,125 generates the following problem while folding both edges of the film behind the forward-moving tray.

Concretely, a pair of rods which are secured to a pair of endless chains and available for catching both edges of the film behind the tray shift themselves at a speed faster than that is used for conveying trays via the rotation of those endless chains. In consequence, these rods shifting themselves at a fast speed respectively cause both edges of the film behind the tray to instantaneously leave the suction tubes, and as a result, the film cannot be elongated to full extent.

In addition, generally, the bottom surface of each tray has a lateral width which is narrower than that of the top surface. In particular, the less the volume of the tray, the wider the lateral width of a tubular film than the width of the bottom surface of the tray. This in turn incurs unwanted protrusion of the folded film from the lateral width of the tray.

DISCLOSURE OF THE INVENTION

Therefore, the primary object of the invention is to provide a novel apparatus for folding film, which is capable of extending time needed for pulling both edges of a cut-off tubular film and making the suction port of the vacuum suction tube smaller than the conventional ones so that sufficient elongation can be provided for the film.

The secondary object of the invention is to provide a novel apparatus for folding film, which is capable of variably adjusting width of the film in correspondence with lateral width of each tray subject to a packaging process.

To achieve the former object, the apparatus for folding film proposed by the invention comprises a means for reciprocating a first suction tube by shifting this in the direction identical to the tray-conveying direction so that the first suction tube can return to the original position by the time when the following tray arrives at this position.

Furthermore, in order to achieve the latter object, the apparatus for folding film proposed by the invention comprises a pair of guide wall members which are disposed in the manner being tapered from the top to the bottom alongside of the inner lateral surfaces on both sides of both suction tubes and a means for adjusting interval between these two guide wall members.

Simultaneous with execution of the film-cutting operation, the first suction tube applies suction to an edge of a tubular film, and at the same time, the first suction tube shifts itself in the direction identical to that of the moving tray at a speed identical to that is exerted for transferring the tray forward. Therefore, even when a plurality of bar-like members available for folding the cut-off film catch both edges of the film while shifting themselves at a speed faster than the forward movement of trays, the first suction tube can hold the film for a long duration.

Owing to the provision of a pair of guide wall members in the tapered form from the top to the bottom direction alongside of the inner lateral surfaces on both sides of the first suction tube, flow of air for applying suction to both edges of the film from the top to the bottom direction converges in the direction of the center. As a result of the generation of this air flow, lateral width of both edges of the film is contracted to enable the apparatus to properly fold the film alongside of the bottom surface of the corresponding tray and properly adjust interval between a pair of guide wall members in correspondence with the lateral width of the corresponding tray.

The above and further objects and features of the invention will more fully be understood from the following description in association with the accompanying drawings.

DESCRIPTION OF THE PREFERRED EMBODIMENTS

Figure 1:
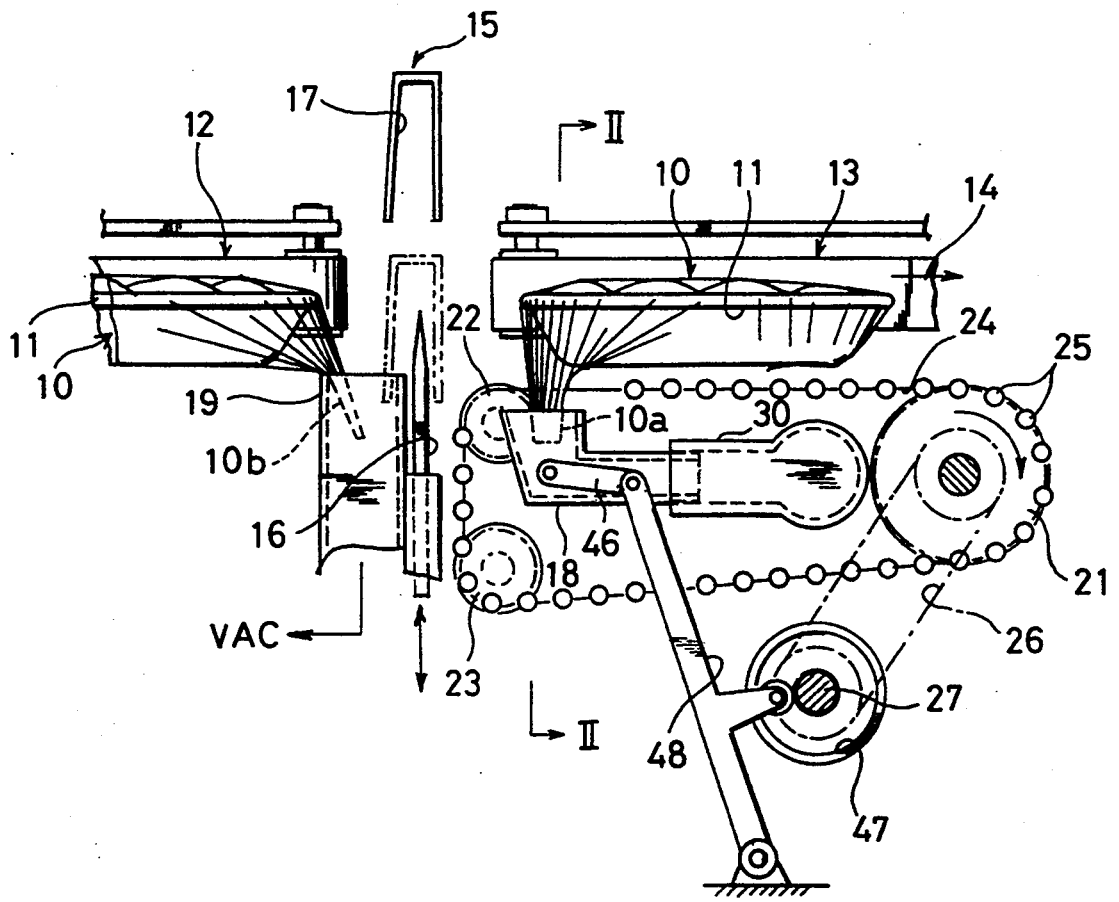
FIG. 1 is a simplified lateral view of the apparatus related to the invention.
Figure 2:
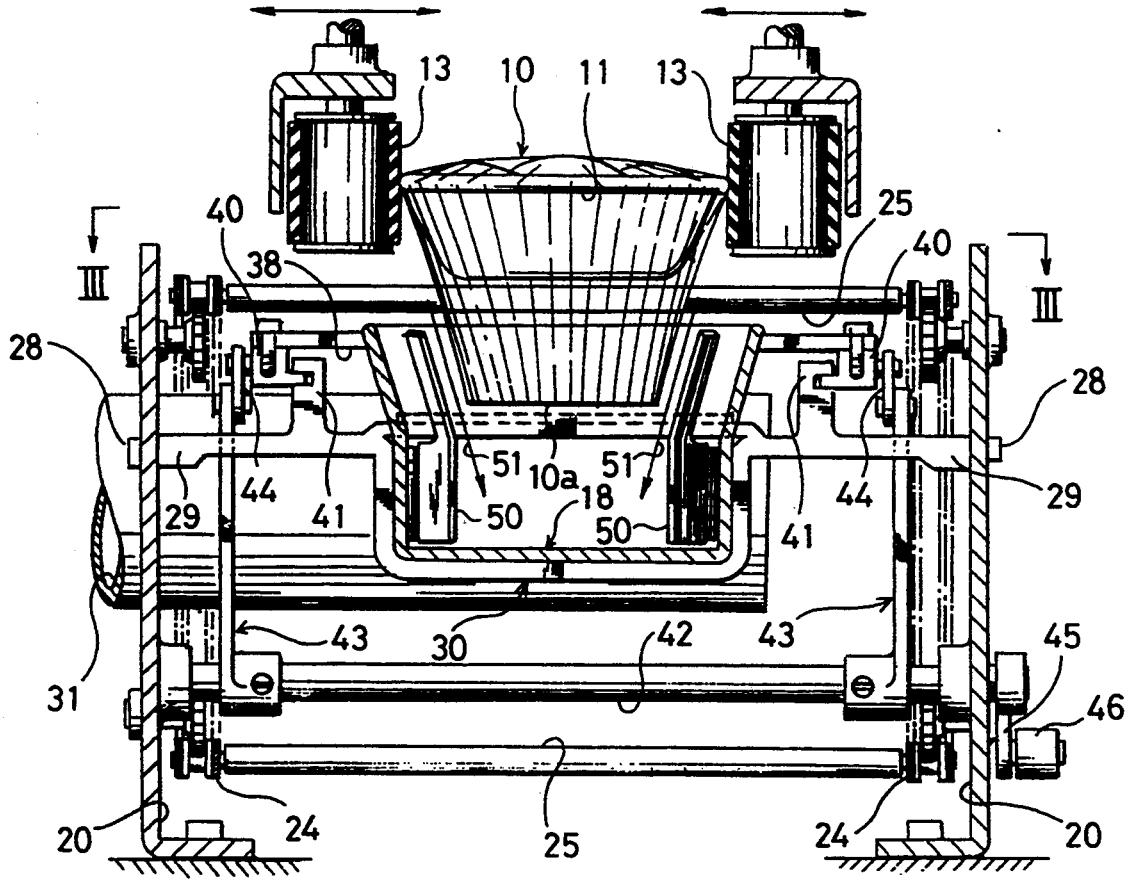
FIG. 2 is a schematic view of the apparatus related to the invention across arrowed line II through II shown in FIG. 1.

As shown in FIGS. 1 and 2, an individual tray 11 disposed in a tubular film 10 is sandwiched by a pair of side belts 12 and 13 which continuously convey the tray 11 in conjunction with the tubular film 10 in the arrowed direction 14 via own rotation. A blade 16 and an inverse-groove-like guillotine 17 jointly composing a cutting unit 15 respectively move themselves in the vertical direction based on a predetermined cycle to cut off the tubular film 10 between the front and rear trays. Simultaneously, a pair of suction tubes 18 and 19 respectively apply suction to a pair of edges 10*a* and 10*b* of the cut-off film 10 with vacuum force. A pair of endless chains 24 are engaged with those chain wheels 21, 22, and 23 which are respectively secured to a pair of frames 20 on both sides of the apparatus. A number of bar-shaped rollers 25 are secured in parallel with each other between both-side chains 24. The main chain wheel 21 is linked with a drive shaft 27 via a chain 26. Speed of the rotation of those bar-shaped rollers 25 rotating themselves in the periphery of the first suction tube 18 based on the drive force of the drive shaft 27 is slightly faster than that of the tray 11 conveyed by the side belt 13. Availing of the differential speed, while being subjected to suction by the first suction tube 18, the edge 10*b* of the film behind the tray 11 can be folded alongside of the bottom surface of the tray 11 by causing the edge 10*b* to be engaged with those bar-shaped rollers 25. On the other hand, while being held by the second suction tube 19, the edge 10*b* of the film in front of the tray 11 can automatically be folded on the bottom surface of the tray 11 via forward movement of the tray 11 itself.

Figure 3:
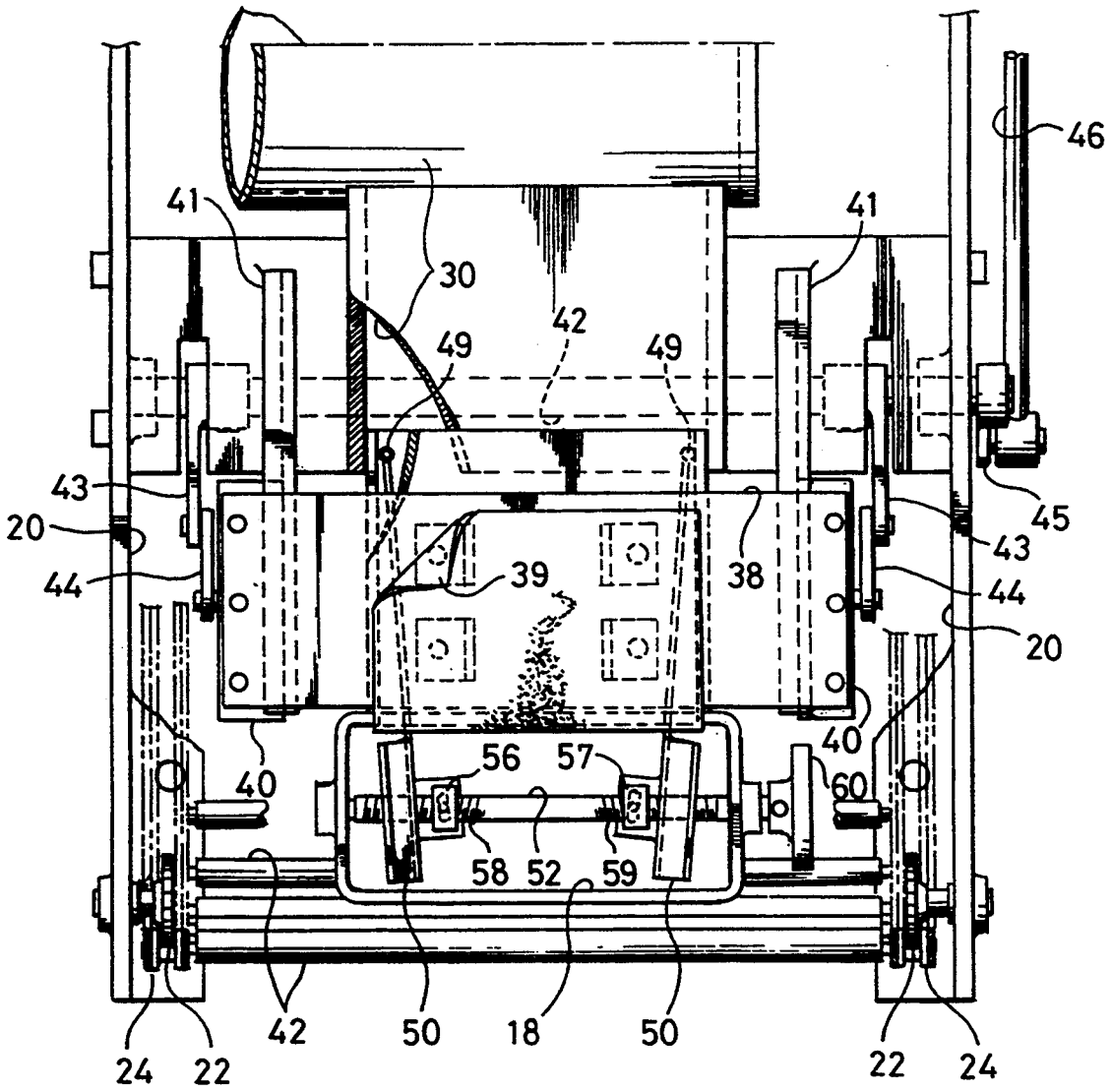
FIG. 3 is a schematic view of the apparatus related to the invention across arrowed line III through III shown in FIG. 1.

As shown in FIGS. 2 and 3, a duct 30 is provided in the center of a pair of wing-shaped plates 29 each being secured with a nut 28 between both-side frames 20. An end of the first suction tube 18 is slidably inserted in this duct 30. Since an end 31 of the duct 30 is linked with a vacuum source, as mentioned earlier, vacuum absorptive force acts upon the first suction tube 18.

Figure 4:
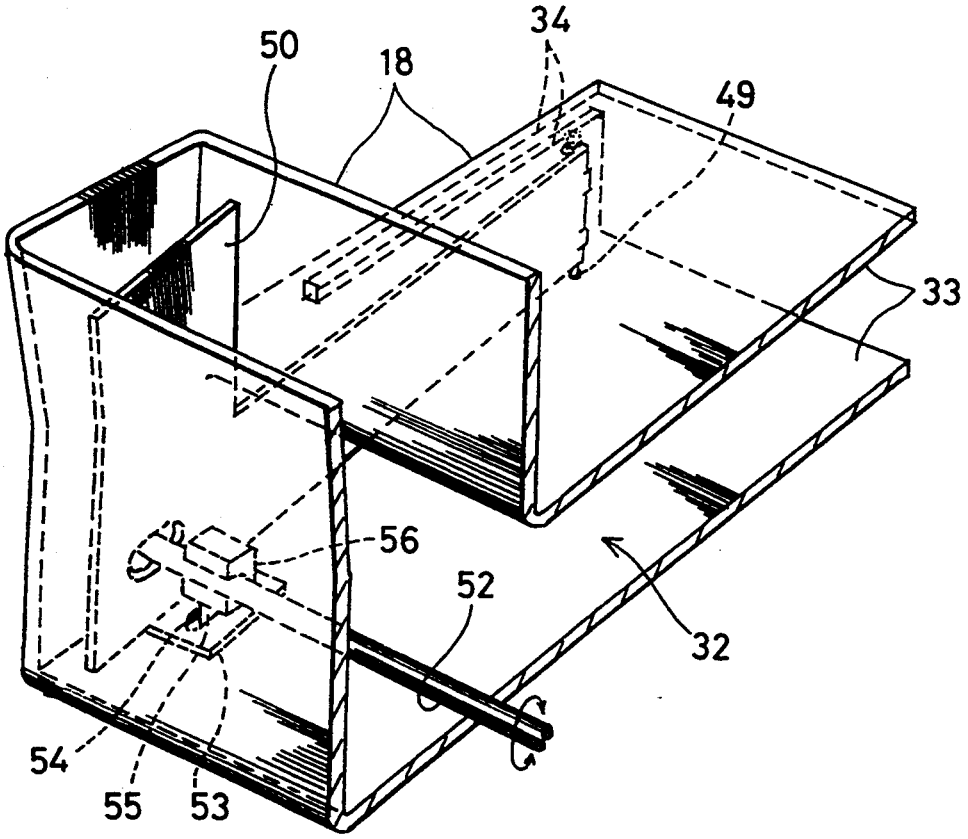
FIG. 4 is a perspective sectional view of the first suction tube provided for the apparatus related to the invention.
Figure 5:
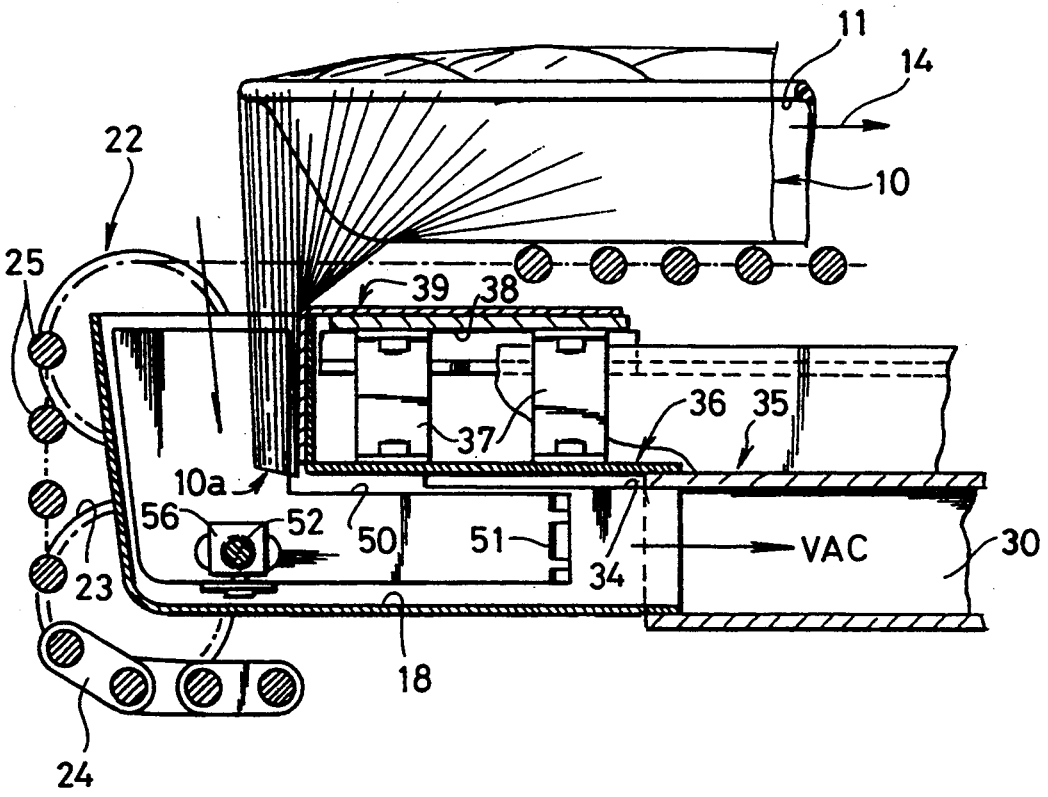
FIG. 5 is a sectional view explanatory of functional operation of the first suction tube of the apparatus related to the invention.

As shown in FIG. 4, an L-shaped passageway 32 is formed in the first suction tube 18. The duct 30 is inserted in a pair of slits 34 formed on both sides of an inserted tubular member 33, and thus, as shown in FIG. 5, a ceiling plate 36 of the first suction tube 18 is placed on a ceiling plate 35 of the duct 30. A table 38 is disposed on the ceiling plate 36 via a pair of supporting legs 37. A rubber sheet 39 is pasted over an area ranging from the top surface of the table 38 to the inner surface of the suction tube 18. The adhered sheet 39 generates high resistance against friction on the film surface to result in the promoted elongation effect of the film.

As shown in FIGS. 2 and 3, the table 38 secured to the first suction tube 18 has an L-shaped sectional slider 40 alongside of both edges being in parallel with the direction of the forward movement of the tray 11.

The slider 40 slidably enters into engagement with a pair of groove-like guide members 41 formed on a pair of wing plates 29 of the duct 30. A pair of levers 43 are respectively secured to a shaft 42 which is rotatably held between these both-side frames 20. These both-side levers 43 are respectively linked with the first suction tube 18 via a pair of links 44. A bell crank 45 secured to an end of the shaft 42 is connected to a rod 46. When these levers 43 are rotated via the shaft 42 by shoving and drawing the rod 46 in the axial direction, the first suction tube 18 slidably installed to the duct 30 reciprocates itself in the tray conveying direction shown in FIG. 1. A main lever 48 is engaged with a groove cam 47 secured to the drive shaft 27. By transmitting swing movement of the main lever 48, stroke movement of the first suction tube 18 can be synchronized with the movement for conveying the tray 11. Concretely, an and 10*a* of the film is closely set to the bottom surface of the first tray 11, and then the first suction tube 18 can be brought back to the original point on the upstream side before operating the cutting unit 15 to cut off the tubular film between the second and third trays 11.

Figure 6:
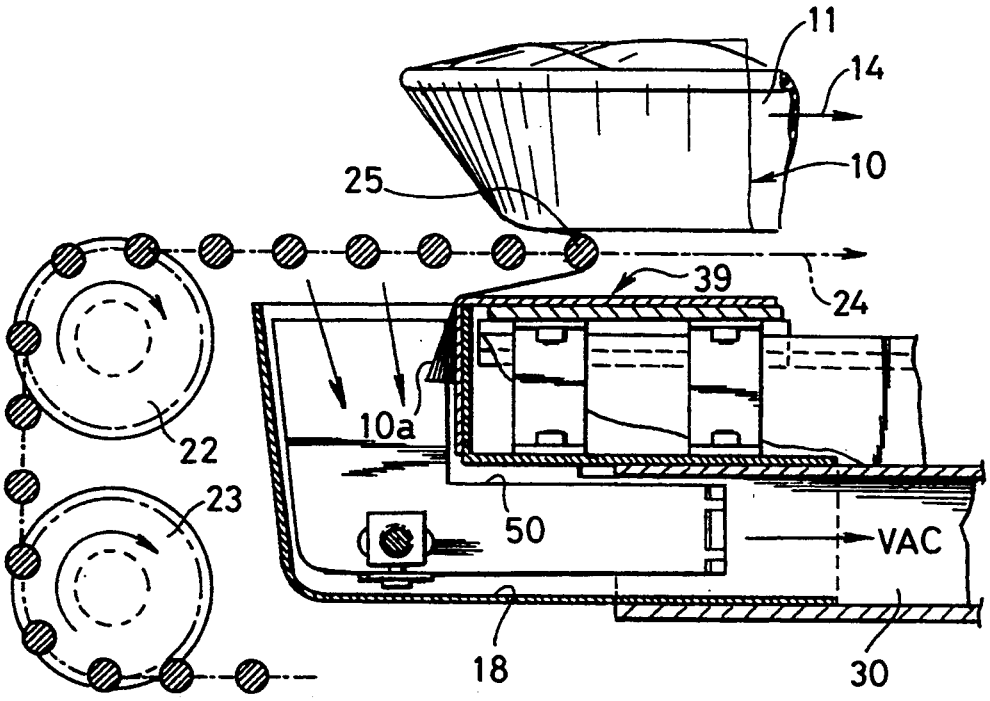
FIG. 6 is a sectional view explanatory of processes of the functional operation shown in FIG. 5.

As shown in FIG. 5, simultaneous with an operation to apply suction an edge 10 of the film behind the tray 11 in the first suction tube 18, the first suction tube 18 shifts itself (see FIG. 6) in the direction identical to the direction 14 of conveying the tray 11 in order that the first suction tube 18 can keep on applying suction to the film edge 10*a* even when those bar-shaped rollers 25 move themselves at a speed faster than that is available for conveying the tray 11 to catch the film. In this case, because of friction with the sheet 39, both ends of the elongatable film are elongated before being folded on the bottom surface of the tray 11.

Figure 7:
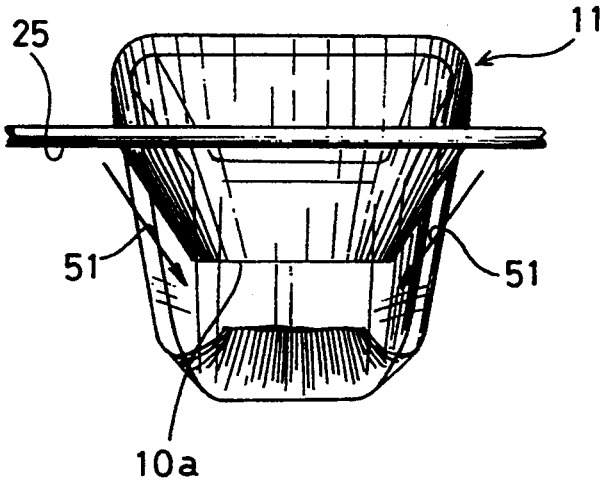
FIG. 7 is explanatory of functional operation via oblique view of the bottom surface of a tray.

As shown in FIGS. 3 and 4, a pair of L-shaped guide wall members 50 are disposed in passageway of the first suction tube 18. These guide wall members 50 are axially supported in the inner space on both sides of the first suction tube 18 by means of a pair of pins 49. As shown in FIG. 2, interspace between the both-side guide wall members 50 is tapered in the downward direction, and therefore, by effect of air flow 51 being sucked in along the both-side guide wall members 50, the film edge 10*a* naturally transforms itself into tapered state. As is apparent from FIG. 7, immediately before being folded on the bottom surface of the tray 11 by means of the corresponding bar-shaped rollers 25, the film edge 10*a* is shaped into such width narrower than that of the bottom surface of the tray 11 by effect of the air flow sucked in.

A threading bar 52 is rotatably disposed between both-side walls of the first suction tube 18 by way of penetrating the both-side guide wall members 50. A pair of female blocks 56 and 57 are engaged with a pair of lengthy holes 54 of a pair of brackets 53 connected to the bottom ends of the both-side guide wall members 50 via a pair of pins 55. These female blocks 56 and 57 are respectively engaged with a right-side screw 58 and a left-side screw 59 formed on the threading bar 52. When rotating the threading bar 52 by operating a handle 60 secured to an end of the threading bar 52, interspace between the both-side guide wall members 50 can be varied by way of pivoting on a pair of pins 49.

Figure 8:
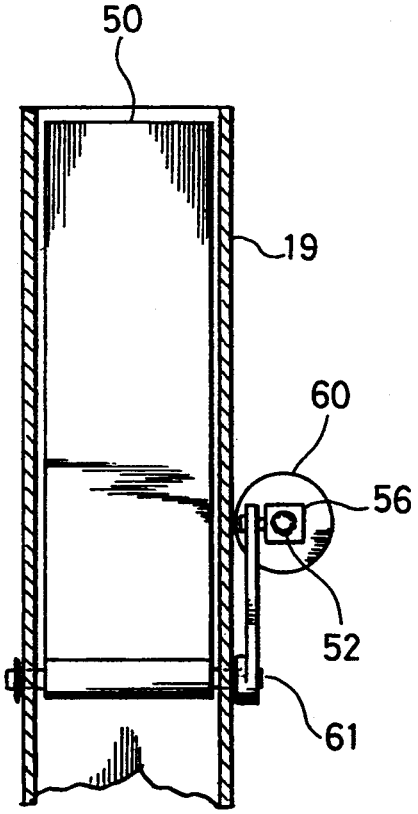
FIG. 8 is a lateral view of a pair of guide wall members inside of the second suction tube.
Figure 9:
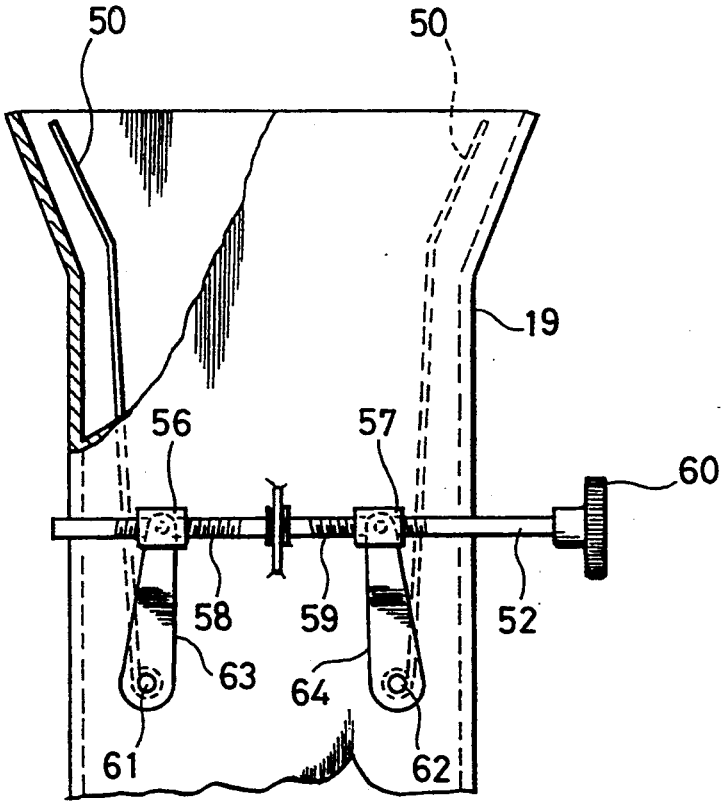
FIG. 9 is a front view of the guide wall members shown in FIG. 8.

As shown in FIGS. 8 and 9, a pair of guide wall members 50 are also disposed on both sides of the inner space of the second suction tube 19. Except for those constant factors specified below, substantially identical means is introduced for operating those guide wall members 50 provided for the second suction tube 19 in the same way as is available for operating those guide wall members 50 provided for the first suction tube 18.

1: Distance between a pair of pins 61 and 62

2: Angle between a pair of levers 63 and 64 which are swingably supported by a pair of female blocks 56 and 57 and those guide wall members 50.

What is claimed is:

1. An apparatus for folding a film available for covering a tray, comprising: a cutting unit for cutting a tubular film covering trays and being transferred between each of said trays; a second suction tube for sucking vertically downwardly with vacuum suction force a front-side end of the film cut off by said cutting unit on the upstream side of the transfer direction of the film, and to fold the end portion of the film along the bottom surface of the tray with the moving force of the tray; a first suction tube for sucking vertically downwardly with vacuum suction force the rear-side end of the tubular film cut off by said cutting unit on the downstream side; and bar-like rollers which rotate in the circumference of the second suction tube at a faster speed than the transfer speed of the film so as to hold the rear-side end portion of the film sucked by the first suction tube in order that the end portion of the film can be folded along the bottom surface of the tray; said apparatus further comprising:

a reciprocating mechanism for moving said first suction tube synchronously with said tray in moving speed and transfer direction, and returning said first suction tube to its original position before the following tray arrives.

2. An apparatus for folding a film available for covering a tray as set forth in claim 1, wherein said first and second suction tubes respectively comprises a pair of guide walls tapered downwardly and disposed on both sides of the inner space of the respective suction tube, and means for fixing said pair of guide walls at a desired position by adjusting the distance therebetween.

* * * * *